US005997322A

United States Patent [19]

Kashiyama et al.

[11] Patent Number: 5,997,322

[45] **Date of Patent: *Dec. 7, 1999**

[54] LIF CONNECTOR WITH A SLIDER

[75] Inventors: Motohisa Kashiyama; Hiroshi Aoki; Masanori Tsuji, all of Shizuoka, Japan

[73] Assignee: Yazaki Corporation, Tokyo, Japan

[ * ] Notice: This patent is subject to a terminal disclaimer.

[21] Appl. No.: 08/998,739

[22] Filed: Dec. 29, 1997

[30] Foreign Application Priority Data

Jan. 8, 1997 [JP] Japan ..... 9-001563

[51] Int. Cl.[6] ..... H01R 13/62

[52] U.S. Cl. ..... 439/157

[58] Field of Search ..... 439/157, 152, 439/153, 347, 344, 270, 953

[56] References Cited

U.S. PATENT DOCUMENTS

| | | | |
|---|---|---|---|
| 3,575,685 | 4/1971 | Gley | 439/157 |
| 5,169,327 | 12/1992 | Hatagishi | 439/157 |
| 5,183,408 | 2/1993 | Hatagishi | 439/157 |
| 5,478,251 | 12/1995 | Jaklin | 439/157 |
| 5,618,194 | 4/1997 | Maue et al. | 439/157 |
| 5,618,195 | 4/1997 | Cappe | 439/157 |
| 5,816,833 | 10/1998 | Hanazaki | 439/157 |
| 5,839,912 | 11/1998 | Schekalla et al. | 439/157 |

FOREIGN PATENT DOCUMENTS

| | | | |
|---|---|---|---|
| 4-319271 | 11/1992 | Japan | H01R 13/629 |
| 611275 | 2/1994 | Japan | H01R 13/629 |
| 6-140094 | 5/1994 | Japan | H01R 13/502 |
| 6-215827 | 8/1994 | Japan | H01R 13/629 |
| 7-169529 | 7/1995 | Japan | H01R 13/629 |

*Primary Examiner*—Khiem Nguyen
*Assistant Examiner*—Michael C. Zarroli
*Attorney, Agent, or Firm*—Sughrue, Mion, Zinn, Macpeak & Seas, PLLC

[57] ABSTRACT

There is disclosed a connector construction in which the operability in the insertion and withdrawal of a connector is greatly enhanced, and an installation space is reduced, and the rigidity is increased, and the number of component parts is reduced, thereby simplifying the construction. An LIF connector includes a first connector, a second connector for being inserted into and withdrawn from the first connector, and a slider for inserting and withdrawing the second connector relative to the first connector. The first connector includes a reception portion for receiving the second connector, and a through hole communicating with the reception portion. The second connector includes a driven shaft for being inserted into the through hole in the first connector, and guide pins projecting perpendicularly from the driven shaft. The slider includes a box-like body having an open bottom, and slanting cam grooves formed respectively in opposed side walls of the box so as to respectively guide the guide pins of the second connector.

14 Claims, 9 Drawing Sheets

LIF CONNECTOR WITH A SLIDER

BACKGROUND OF THE INVENTION

1. Field of the Invention

This invention relates to an LIF connector having an LIF (low insertion force) mechanism by which a multi-pole connector, having many terminals, can be easily inserted into and withdrawn from a mating connector.

The term "connector", used in this specification of the present invention, means a connector including a housing having at least male terminals or female terminals mounted therein, and the housing may be either separate from or integral with other member.

2. Related Art

A multi-pole connectors has a plurality of terminals, and therefore a large insertion/withdrawal force is required for inserting and withdrawing the connector relative to a mating connector, and it has been rather difficult to effect the insertion and withdrawal of the connector. In view of the difficulty of insertion and withdrawal of such a multi-pole connector, there have now been proposed various connectors (LIF connectors) having an LIF mechanism.

Representative examples of such conventional LIF connectors includes one in which a connector is inserted and withdrawn by operating a lever, and one in which a connector is inserted and withdrawn by operating a slider.

One example of LIF connectors, in which the connector is inserted and withdrawn by operating the lever, is disclosed in Japanese Patent Unexamined Publication No. 7-169529. FIG. 1 is an exploded, perspective view of the LIF connector disclosed in Japanese Patent Unexamined Publication No. 7-169529.

This LIF connector comprises a first connector 110 having female terminals (not shown), and a second connector 120 having male terminals (not shown).

A cam lever 111, having an eccentric cam 111a formed integrally therewith, is provided on the first connector 110, and this cam lever 111 is pivotally mounted through a pivot shaft 113 on support portions 112 and 112 formed upright on a central portion of the first connector 110. Two pairs of lock pawls 114 for locking the cam lever 111 when this lever is pivotally moved 180° are formed respectively on opposite end portions of the upper surface of the first connector 110.

A driven shaft 121 is formed upright on a central portion of the second connector 120. The driven shaft 121 is pivotally connected to the eccentric cam 111a of the cam lever 111 through an insertion hole (not shown) extending through a central portion of the first connector 110.

With this construction, when the cam lever 111 is operated, the driven shaft 121 is moved upward and downward, and the second connector 120 is inserted into and withdrawn from the first connector 110. Namely, with a small force obtained by operating the cam lever 111, the multi-pole connector can be inserted into and withdrawn from the mating multi-pole connector.

Another example of LIF connectors, in which the connector is inserted and withdrawn by operating the lever, is disclosed in Japanese Patent Unexamined Publication No. 6-140094.

One example of LIF connectors, in which the connector is inserted and withdrawn by operating the slider, is disclosed in Japanese Patent Unexamined Publication No. 4-319271. FIG. 2 is an exploded, perspective view of the LIF connector disclosed in Japanese Patent Unexamined Publication No. 4-319271.

This LIF connector comprises a plurality of connectors 211 and 212, a rectangular frame-like holder 220 for receiving these connectors 211 and 212, a mating connector 230 for receiving the connectors 211 and 212 received in the holder 220, and a slider 240 of a generally U-shape for inserting and withdrawing the connectors 211 and 212 relative to the connector 230.

A pair of projections 221 and 221 are formed on each of upper and lower surfaces of the holder 220, and insertion holes 231 and 231 for the slider 240 are formed respectively through opposite end walls of the mating connector 230, and a pair of cam grooves 241 and 241, corresponding to the projections 221 and 221, are formed in each of upper and lower walls of the slider 240.

In the LIF connector of the above construction, the slider 240 is inserted into a predetermined position in the mating connector 230, and the projections 221 on the holder 220 are positioned respectively relative to the cam grooves 241 in the slider 240. Then, when the slider 240 is pushed into the mating connector 230, the projections 221 on the holder 220 move respectively along the cam grooves 241 in the slider 240, so that the connectors 211 and 212, received in the holder 220, are inserted into the mating connector 230.

Namely, in this LIF connector, by merely pushing the slider 240, the connectors 211 and 212 can be easily fitted into the mating connector 230.

However, the above conventional LIF connector, having the lever, is inferior in operability to the LIF connector having the slider.

More specifically, in the LIF connector having the slider, the connectors can be inserted into and withdrawn from the mating connector merely by linearly moving the slider 240. However, in the LIF connector having the lever, the cam lever 111 must be pivotally moved so as to insert and withdraw the connector, and when pivotally moving the cam lever 111, a release operation, in which the cam lever 111 is released from the lock pawls 114 and 114, is involved.

In addition, a space for allowing the cam lever 111 to be pivotally moved 180° must be secured at the upper side and lateral sides, and therefore there has been encountered a problem that a large installation space is needed. Furthermore, in the case where one of the connectors 110 and 120 to be fitted together and removed from each other is provided integrally in a junction block, it is difficult to secure the installation space since this junction block is usually mounted in a small space where wires are installed densely. Even if the connector is installed, there has been encountered a problem that the cam lever 111 can not be operated.

Further, the support portions 112 and 112 and the pivot shaft 113, which pivotally support the cam lever 111, and the lock pawls 114 for locking the cam lever 111 are the essential constituent parts, and thus the number of the component parts is large, which has invited a problem that the construction is complicated.

On the other hand, in the LIF connector having the above slider, although the slider 240 can be easily inserted into the insertion holes 231 and 231 in the mating connector 230, it is difficult to withdraw the slider 240, and therefore the connectors 211 and 212 can not be easily withdrawn.

In addition, the slider 240 is designed to be inserted into the mating connector 230, its configuration is naturally limited to a generally U-shape, and therefore there has been encountered a problem that the rigidity of the slider 240, on which a large force acts when inserting and withdrawing the connectors 211 and 212 relative to the connector 230, is very low.

Furthermore, since the slider 240 is inserted into the mating connector 230 in a direction of the length of this mating connector 230, the slider 240 has a large length, which has invited a problem that its rigidity is further reduced.

SUMMARY OF THE INVENTION

With the above problems in view, it is an object of this invention to provide an LIF connector which has a construction provided by combining the features of the lever-type LIF connector and the slider-type connector together, and with this construction the operability in the insertion and withdrawal of a connector is greatly enhanced, and an installation space is reduced, and the rigidity is increased, and the number of component parts is reduced, thereby simplifying the construction.

The above object has been achieved by an LIF connector according to a first aspect of the present invention comprising a first connector, a second connector for being inserted into and withdrawn from the first connector, and a slider for inserting and withdrawing the second connector relative to the first connector; wherein the first connector includes a reception portion for receiving the second connector, and a through hole communicating with the reception portion; the second connector includes a driven shaft for being inserted into the through hole in the first connector, and guide pins projecting perpendicularly from the driven shaft; and the slider includes a box-like body having an open bottom, and slanting cam grooves formed respectively in opposed side walls of the box so as to respectively guide the guide pins of the second connector.

In the LIF connector of the invention having the above construction, the slider is first set on the first connector, and then the driven shaft of the second connector is inserted into the through hole in the first connector, and the guide pins, formed on the driven shaft projecting from the through hole, are introduced respectively into the openings in the cam grooves in the slider.

In this condition, when the slider is slid, the guide pins are guided respectively along the cam grooves, and the driven shaft is pulled toward the first connector. As a result, the second connector is inserted into the reception portion of the first connector, and terminals in the first connector are electrically connected respectively to terminals in the second connector.

When the slider is returned to its initial position, the guide pins are guided respectively along the cam grooves in the slider, and the driven shaft is pushed back away from the first connector. As a result, the second connector is withdrawn from the reception portion of the first connector, and the electrical connection between each mating pair of terminals of the first and second connectors is broken.

Namely, in the LIF connector of the present invention, an LIF mechanism is constituted by the slider and the driven shaft, and the driven shaft is operated by the slider, and thus this construction is provided by combining the features of the lever-type LIF connector and the slider-type LIF connector together.

As a result, merely by sliding the slider over the first connector, the second connector can be easily inserted and withdrawn, and besides it is only necessary to secure a space for allowing the sliding movement of the slider, and therefore the installation space can be reduced.

The slider has the box-like body, and therefore has an increased rigidity, and besides the LIF mechanism can be constituted only by the slider and the driven shaft, and therefore the number of the component parts is reduced, thereby simplifying the construction.

In the LIF connector according to a second aspect of the present invention, rails or guides are formed respectively on the side walls of the slider, and guides or rails for respectively guiding the rails or the guides of the slider are formed on the first connector.

With this construction, the sliding movement of the slider is made smooth, and the connector insertion/withdrawal operation can be effected easily and positively.

In the LIF connector according to a third aspect of the present invention, an opening for introducing the guide pin of the second connector into the cam groove in the slider is formed at one end of each of the cam grooves, and holders for respectively guiding the guide pins of the second connector into the openings are provided outwardly of the openings of the cam groove, respectively.

With this construction, the openings of the cam grooves in the slider can be easily positioned respectively relative to the guide pins of the second connector, and the guide pins can be easily introduced respectively into the cam grooves.

In the LIF connector according to a fourth aspect of the present invention, holder guides for respectively guiding the holders of the slider are formed on the first connector.

With this construction, the holders can be used as guides, and the sliding movement of the slider can be made more smooth.

In the LIF connector according to a fifth aspect of the present invention, an anti-slip portion for enabling the finger to slide the slider is formed on an upper surface of the slider.

With this construction, the slider can be easily slid with the finger held against the anti-slip portion.

DESCRIPTION OF THE PREFERRED EMBODIMENT OF THE INVENTION

One preferred embodiment of an LIF connector of the present invention will now be described with reference to the drawings.

Figure 1:
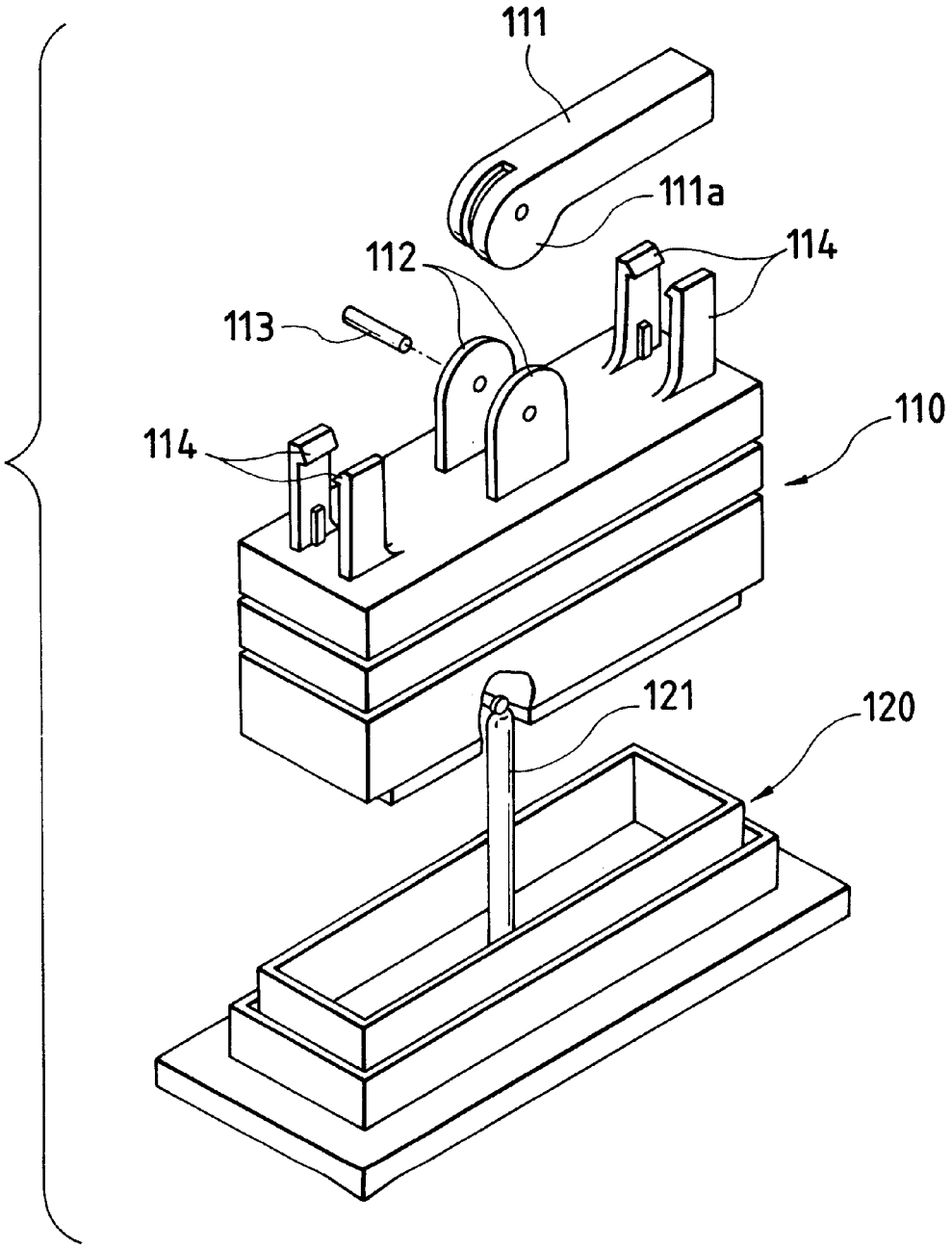
FIG. 1 PRIOR ART
FIG. 1 is an exploded, perspective view of a conventional LIF connector.
Figure 2:
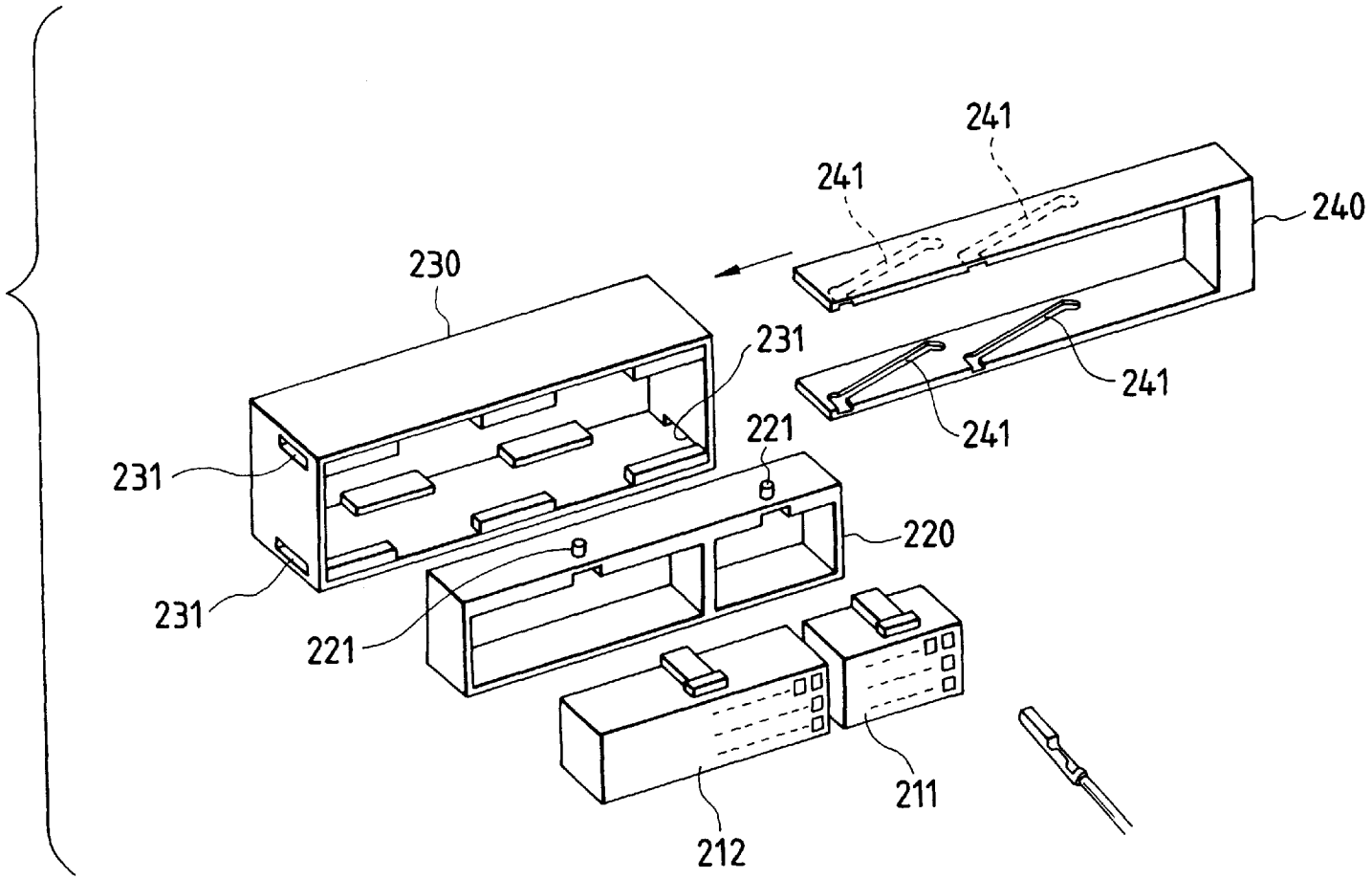
FIG. 2 PRIOR ART
FIG. 2 is an exploded, perspective view of a conventional LIF connector.
Figure 3:
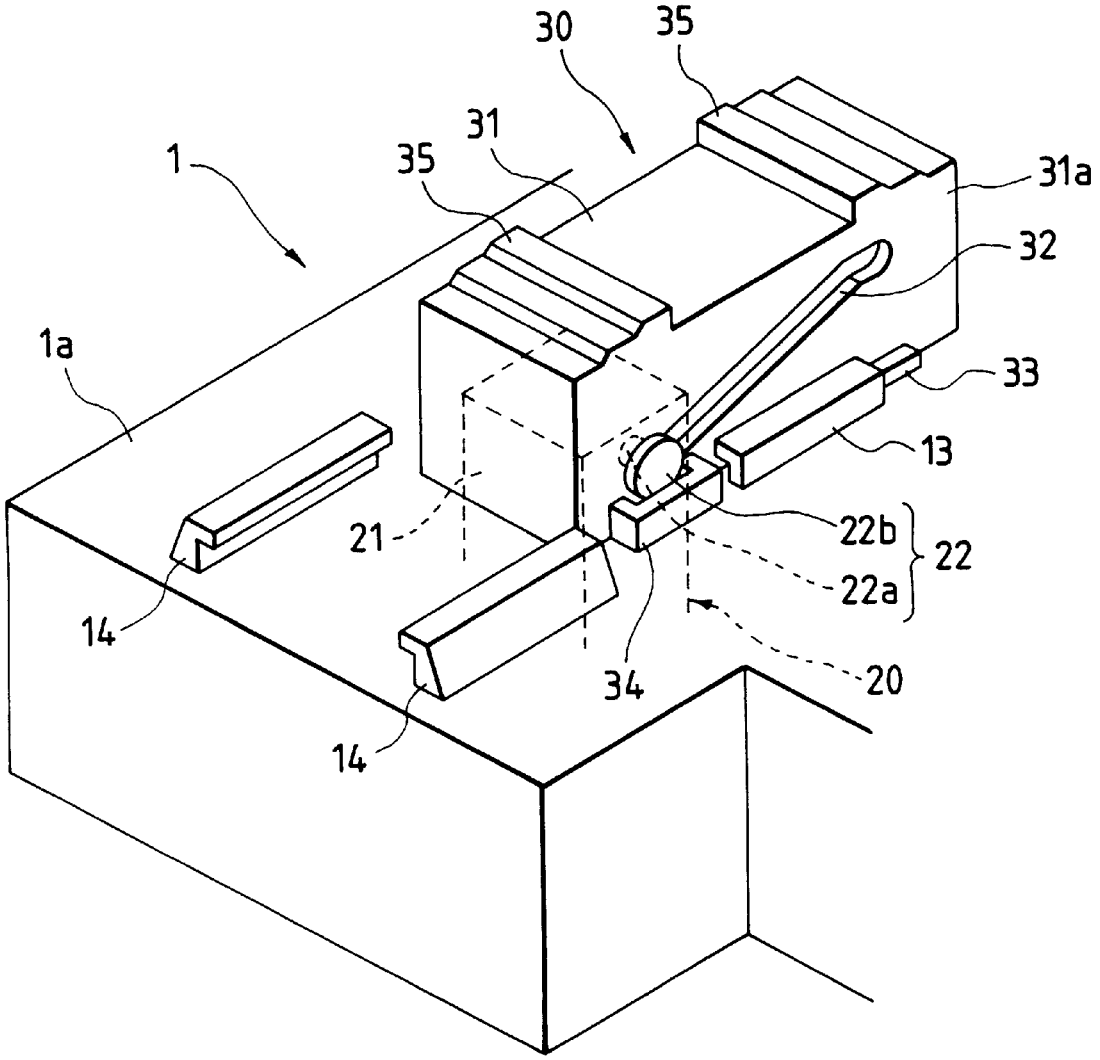
FIG. 3 is a perspective view of one preferred embodiment of an LIF connector of the present invention.
Figure 4:
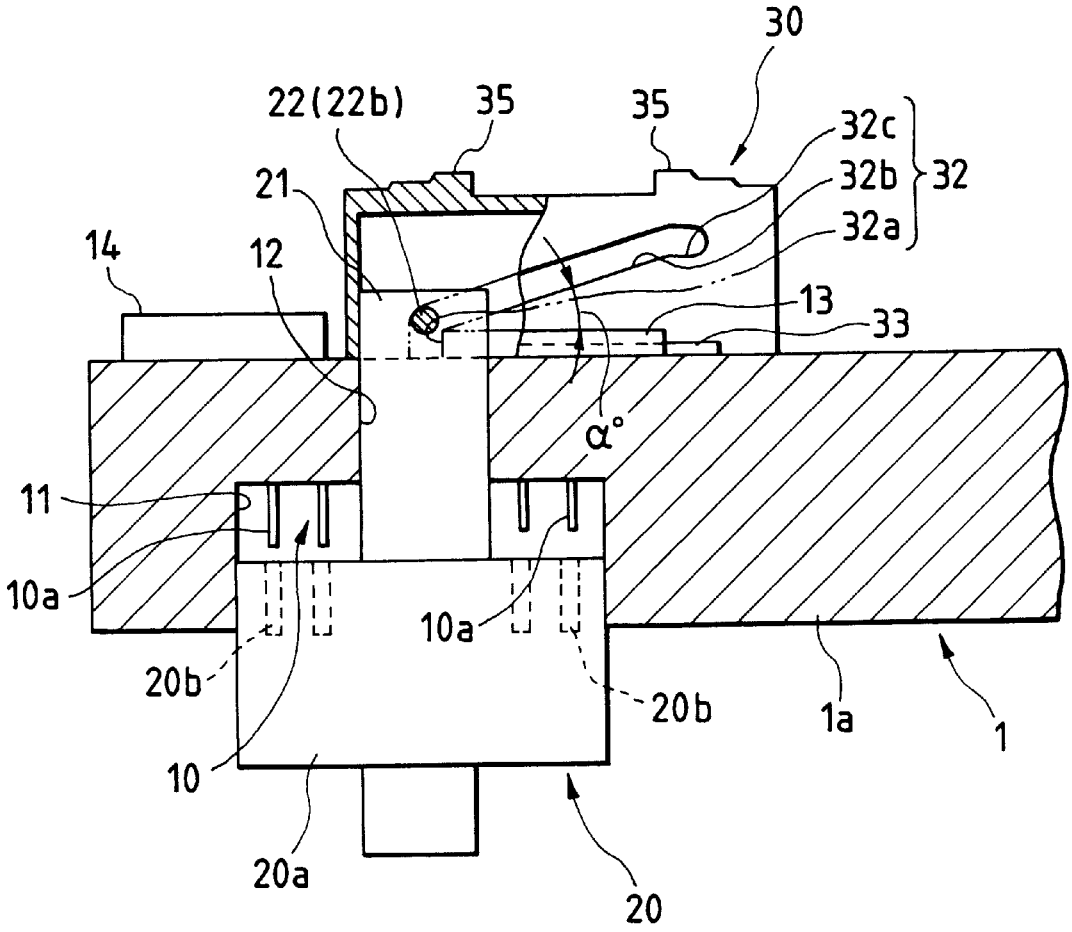
FIG. 4 is a cross-sectional view of the LIF connector.
Figure 5:
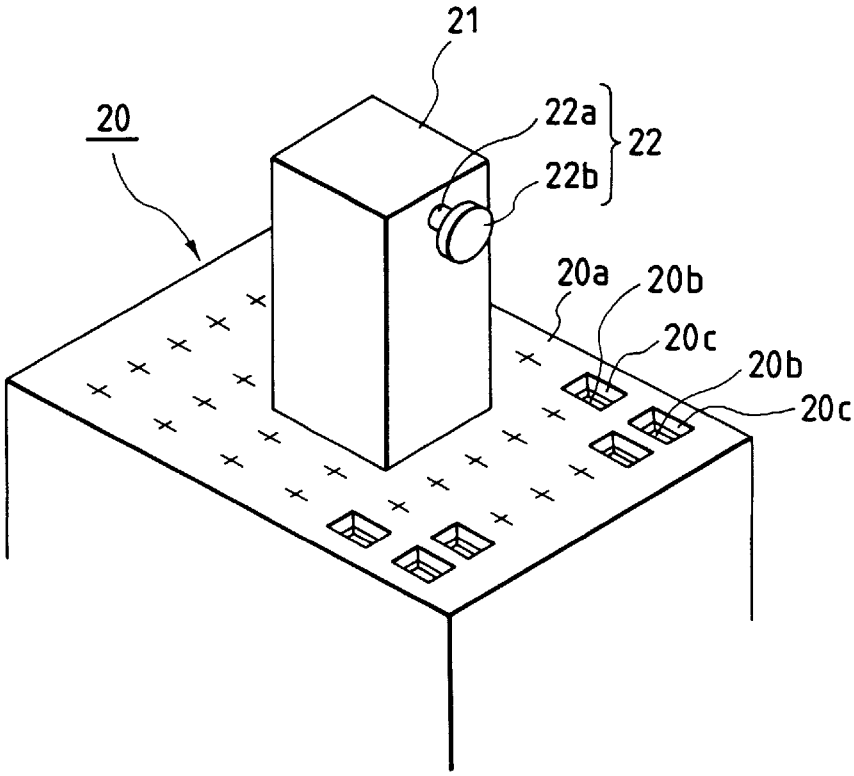
FIG. 5 is a perspective view of a second connector of the LIF connector.
Figure 6:
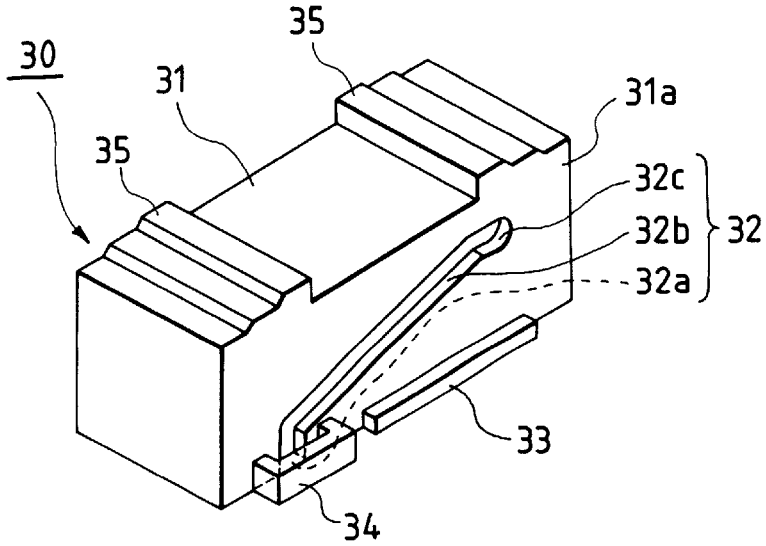
FIG. 6 is a perspective view of a slider of the LIF connector.

FIG. 3 is a perspective view of one preferred embodiment of the LIF connector of the invention, and FIG. 4 is a cross-sectional view of the LIF connector. FIG. 5 is a perspective view of a second connector of the LIF connector, and FIG. 6 is a perspective view of a slider of the LIF connector.

In these Figures, the LIF connector of this embodiment comprises a first connector 10 provided integrally in a junction box 1, the second connector 20 for being inserted into and withdrawn from the first connector 10, and the slider 30 for inserting and withdrawing the second connector 20 relative to the first connector 10.

In FIGS. 3 and 4, the first connector 10 is formed integrally in a housing 1*a* of the junction box 1, as described above. The first connector 10 includes a reception portion 11 for the second connector 20, and many male terminals 10a are projected into this reception portion 11. The male terminals 10a, which may be of varying lengths are formed integrally with a bus bar wiring board (not shown) mounted in the junction block 1. A through hole 12, communicating with the reception portion 11, is formed in the housing 1*a*.

A pair of opposed guides 13 and 13 for respectively guiding rails 33 and 33 formed on the slider 30, as well as a pair of holder guides 14 and 14 for respectively guiding holders 34 and 34 formed on the slider 30, are formed on an upper surface of the housing 1*a*.

In FIGS. 3, 4 and 5, a driven shaft 21 for being inserted into the through hole 12 in the first connector 10 is formed upright at a central portion of the second connector 20. Guide pins 22 project perpendicularly from a distal end portion of the driven shaft 21. The guide pin 22 comprises a cylindrical shank portion 22*a*, and a disk-like stopper 22*b*.

Many female terminals 20*b*, corresponding respectively to the male terminals 10*a* of the first connector 10, are provided in a housing 20*a* of the second connector 20. The female terminals 20*b* are mounted respectively in cavities 20*c* formed in the housing 20*a*.

In FIGS. 3, 4 and 6, the slider 30 includes a box-like body 31 having an open bottom, and slanting cam grooves 32 and 32 for respectively guiding the guide pins 22 of the second connector 20 are formed respectively in opposite side walls 31*a* and 31*a* of the body 31.

As shown in FIG. 4, the cam groove 32 has an opening 32*a* for introducing the guide pin 22 of the driven shaft 21, a slanting groove 32*b* continuous with the opening 32*a*, and a horizontal groove 32*c* for stabilizing the guide pin 22 passed through the slanting groove 32*b*.

In FIG. 4, by reducing an inclination angle $\alpha°$ of the cam groove 32, a force for sliding the slider 30 (that is, an insertion/withdrawal force for the connectors 10 and 20) can be reduced. In contrast, by increasing the inclination angle $\alpha°$ of the cam groove 32, the distance of sliding of the slider 30 can be reduced.

The rails 33 and 33 are integrally formed respectively on the side walls 31*a* and 31*a* of the body 31, and extend respectively along lower edges of these side walls. The holders 34 and 34 for respectively guiding the guide pins 22 of the second connector 20 into the openings 32*a* are formed respectively on the side walls 31*a* and 31*a*, and are disposed outwardly of the openings 32*a* of the cam groove 32, respectively.

Anti-slip portions 35 for enabling the finger to smoothly slide the slider 30 are formed on the upper surface of the slider 30. In this embodiment, although the anti-slip portion 35 has a step-like configuration, it may be replaced by any other suitable configuration, such as a concave-convex configuration and a cross-sectionally serrated configuration in so far as it can prevent a slip of the finger.

The connector insertion/withdrawal operation in the LIF connector of this embodiment will now be described with reference to FIGS. 7(*a*) to 10(*b*).

Figure 7A:
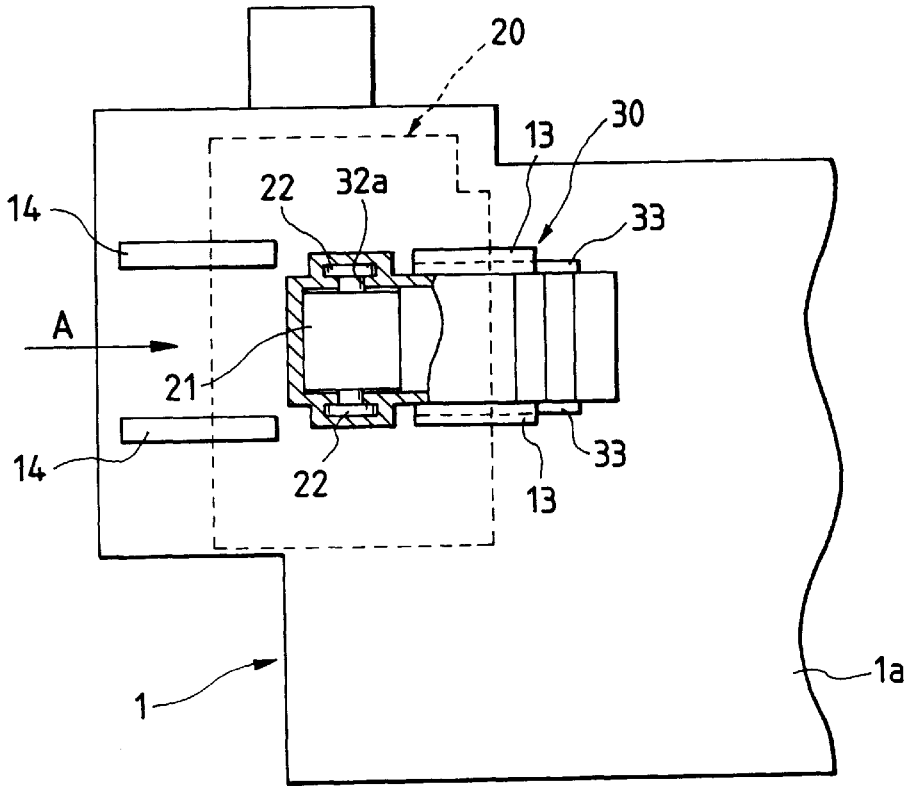
FIGS. 7(*a*) and 7(*b*) are a plan view and a cross-sectional view of the LIF connector, showing a sequence of the connector insertion/withdrawal operation.
Figure 7B:
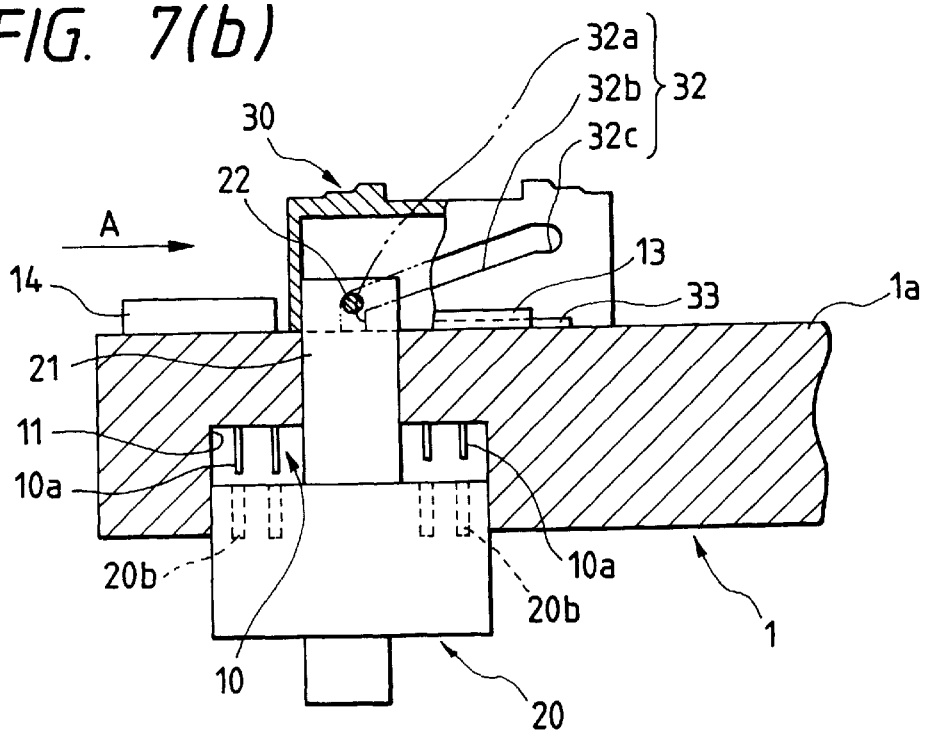

FIGS. 7(*a*) to 10(*b*) show a sequence of the connector insertion/withdrawal operation in the LIF connector of the invention, and FIGS. 7(*a*), 8(*a*), 9(*a*) and 10(*a*) are plan views, and FIGS. 7(*b*), 8(*b*), 9(*b*) and 10(*b*) are cross-sectional views.

In FIGS. 7(*a*) and 7(*b*), for inserting the second connector 20 into the first connector 10, the slider 30 is first set relative to the guides 13 and 13 of the first connector 10. More specifically, the slider 30 is slid over the housing 1*a* of the first connector 10 in a direction of arrow A, with the rails 33 directed toward the first connector 10, thereby setting the rails 33 and 33 relative to the guides 13 and 13, respectively.

After this setting operation is finished, the openings 32*a* of the cam grooves 32 in the slider 30 are positioned respectively relative to the guide pins 22 on the second connector 20, and the guide pins 22 are introduced respectively into the cam grooves 32 through the respective openings 32*a*.

Figure 8A:
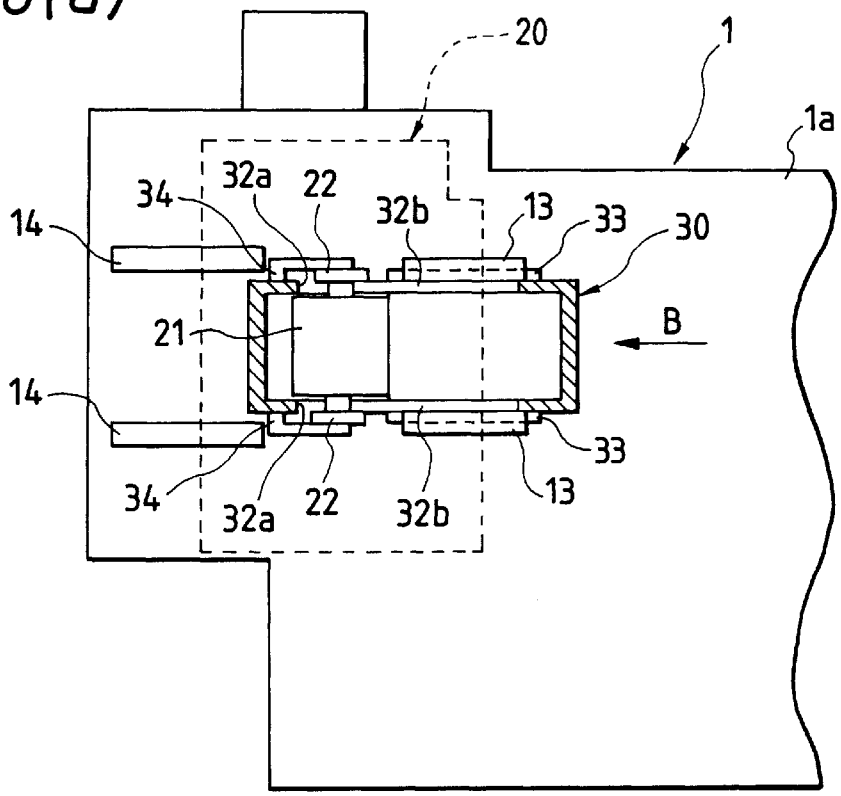
FIGS. 8(*a*) and 8(*b*) are a plan view and a cross-sectional view of the LIF connector, showing a sequence of the connector insertion/withdrawal operation.
Figure 8B:
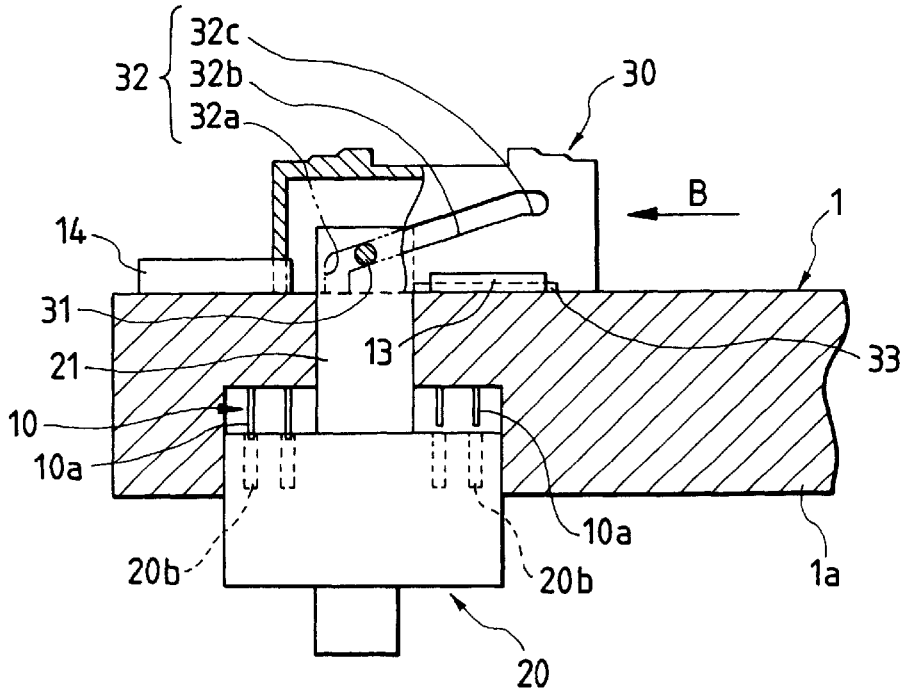

Then, when the slider 30 is slid from the set position in a direction of arrow B as shown in FIGS. 8(*a*) and 8(*b*), the guide pins 22 rise respectively along the slanting grooves 32*b* of the cam grooves 32. As a result, the second connector 20 is pulled toward the upper surface of the reception portion 11 of the first connector 10 through the driven shaft 21.

Figure 9A:
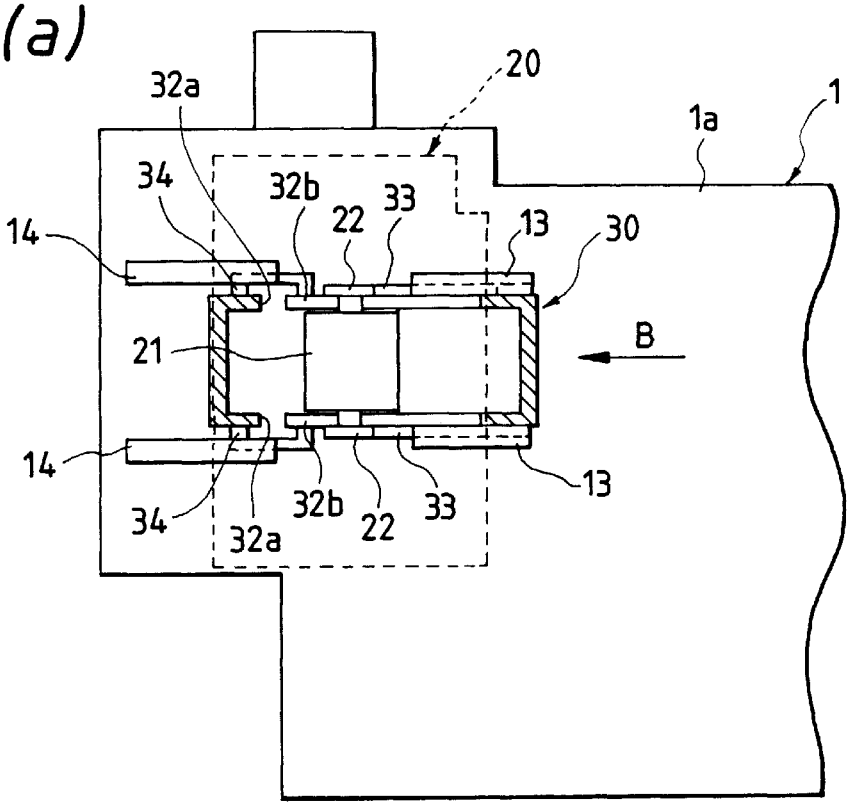
FIGS. 9(*a*) and 9(*b*) are a plan view and a cross-sectional view of the LIF connector, showing a sequence of the connector insertion/withdrawal operation.
Figure 9B:
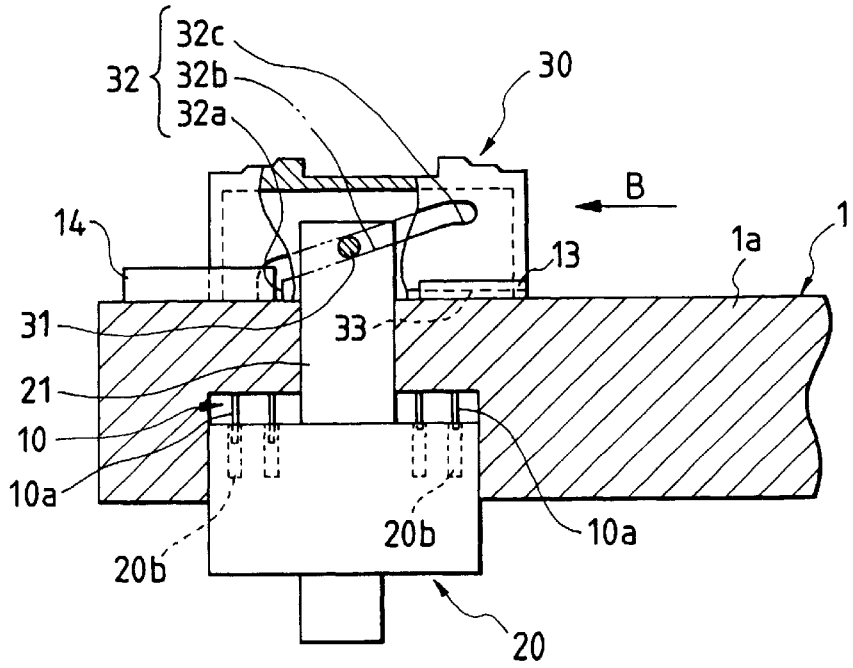
Figure 10A:
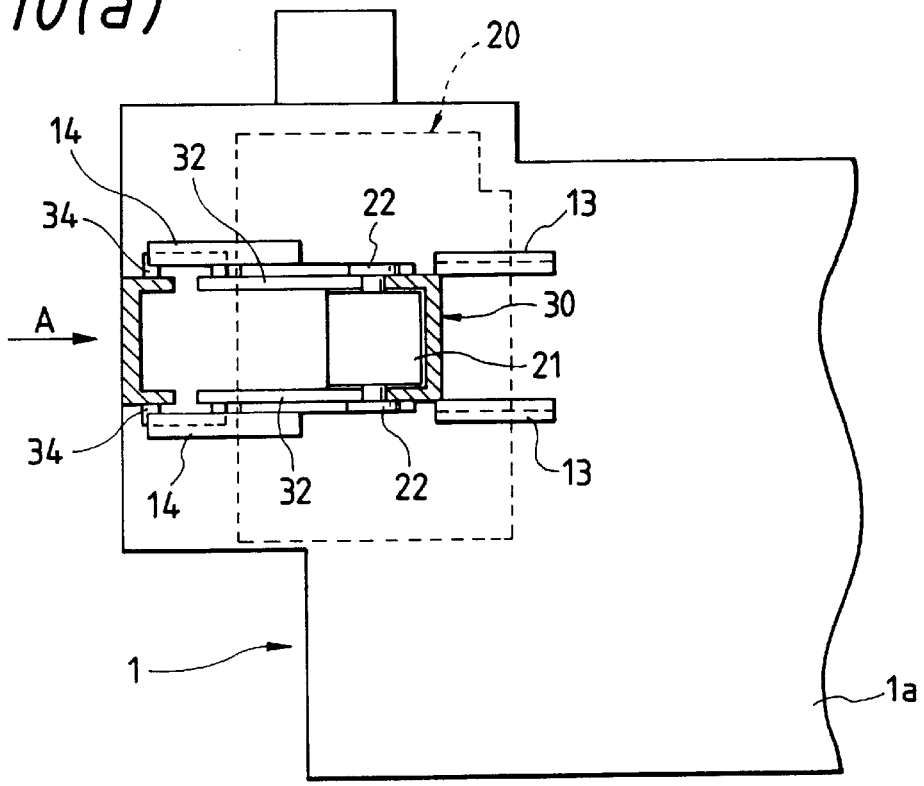
FIGS. 10(*a*) and 10(*b*) are a plan view and a cross-sectional view of the LIF connector, showing a sequence of the connector insertion/withdrawal operation.
Figure 10B:
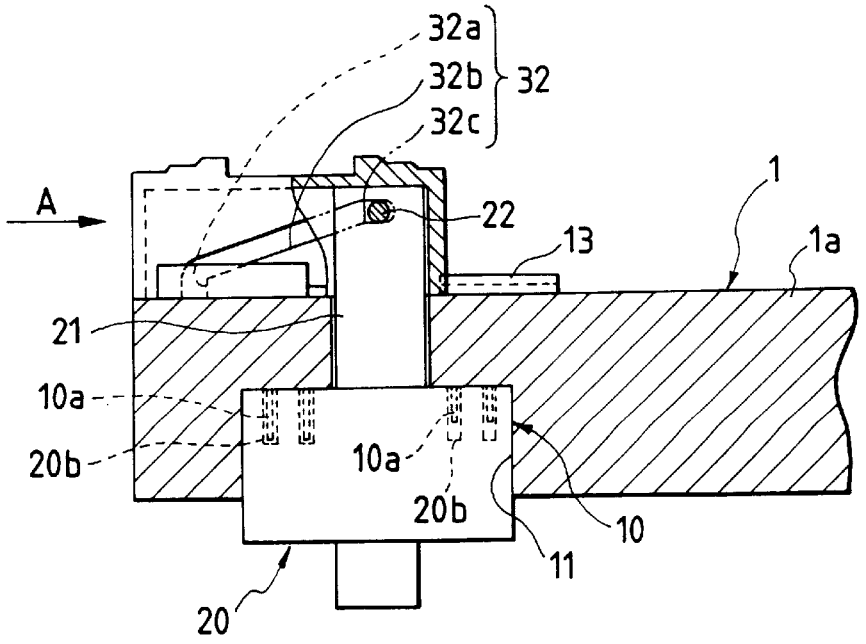

Then, when the slider 30 is further slid in the direction of arrow B as shown in FIGS. 9(*a*) and 9(*b*), each of the guide pins 22 passes past the slanting groove 32*b*, and is introduced into the horizontal groove 32*c* of the cam groove 32 (FIGS. 10(*a*) and 10(*b*).

As a result, the second connector 20 is completely inserted into the reception portion 11 of the first connector 10, and the male terminals l0*a* in the first connector 10 are electrically connected respectively to the female terminals 20*b* in the second connector 20.

For withdrawing the second connector 20 from the first connector 10, the slider 30 in the condition of FIGS. 10(*a*) and 10(*b*) is slid in the direction of arrow A, so that the cam grooves 32 in the slider 30 perform a function reverse to that described above, and therefore the second connector 20 can be withdrawn from the reception portion of the first connector 10.

In the LIF connector of this embodiment, the LIF mechanism is constituted by the slider 30 and the driven shaft 21, and the driven shaft 21 is operated by the slider 30, and thus this construction is provided by combining the features of the lever-type LIF connector and the slider-type LIF connector together.

As a result, merely by sliding the slider 30 over the housing 1*a* of the first connector 10, the second connector 20 can be easily inserted and withdrawn, and besides it is only necessary to secure a space for allowing the sliding movement of the slider 30, and therefore the installation space can be reduced.

Therefore, the present invention is effective particularly when it is applied to the junction box 1, often mounted in a small space where wires are installed densely, as in this embodiment.

The slider 30 has the box-like body, and therefore has an increased rigidity, and also the LIF mechanism can be constituted only by the slider 30 and the driven shaft 21, and therefore the number of the component parts is reduced, thereby simplifying the construction.

The slider 30 is guided by the rails 33, the guides 13, the holders 34 and the holder guides 14, and therefore the sliding movement of the slider 30 is smooth, and the insertion and withdrawal of the second connector 20 relative to the first connector 10 can be effected easily and positively.

The opening 32*a* is formed at one end of each cam groove 32 in the slider 30, and the holders 34 and 34 for respectively guiding the guide pins 22 of the second connector 20 into the associated openings 32*a* are provided outwardly of the openings 32*a*, respectively, and with this construction the guide pins 22 can be easily positioned respectively relative to the openings 32*a*, and the guide pins 22 can be easily introduced respectively into the cam grooves 32.

The holders guides 14 for respectively guiding the holders 34 of the slider 30 are provided on the first connector 10, and therefore the holders 34 can be used as guides, and the sliding movement of the slider 30 can be made more smooth.

The anti-slip portions 35 for enabling the finger to slide the slider 30 are formed on the upper surface of the slider 30, and therefore the slider 30 can be easily slid with the finger held against the anti-slip portion 35.

The LIF connector of the invention is not limited to the above embodiment. For example, although the first connector 10 is integrally formed in the housing 1*a* of the junction box 1, the first connector can have an independent housing.

As described above, the LIF connector of the present invention has the construction provided by combining the features of the lever-type LIF connector and the slider-type connector together, and with this construction the operability in the insertion and withdrawal of the connector is greatly enhanced, and the installation space is reduced, and the rigidity is increased, and the number of the component parts is reduced, thereby simplifying the construction.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. An LIF connector comprising a first connector (10), a second connector (20) for being inserted into and withdrawn from said first connector (10), and a slider (30) for inserting and withdrawing said second connector (20) relative to said first connector (10);

wherein said first connector (10) includes a reception portion (11) for receiving said second connector (20), and a through hole (12) communicating with said reception portion (11);

wherein said second connector (20) includes a driven shaft (21) for being inserted into said through hole (12) of said first connector (10), and guide pins (22) projecting perpendicularly from said driven shaft (21); and wherein said slider (30) includes a box-like body (31) having an opened bottom, and slanting cam grooves (32) formed respectively in opposed side walls (31a, 31a) of said box-like body (31) so as to respectively guide said guide pins (22) of said second connector (20).

2. The LIF connector according to claim 1, wherein guided members (33) are formed respectively on the opposed side walls (31*a*, 31*a*) of said slider (30), and guiding members (13) for respectively guiding said guided members (33) of said slider are formed on said first connector (10).

3. The LIF connector according to claim 2, wherein each of said guided members is one of a rail and a guide, and each of said guiding member is one of a guide element for guiding said rail and a rail element for guiding said guide.

4. The LIF connector according to claim 1, wherein an opening (32*a*) for introducing said guide pin (22) of said second connector (20) into said slanting cam groove (32) of said slider (30) is formed at one end of each of said slanting cam grooves (32), and holders (34) for respectively guiding said guide pins (22) of said second connector (2) into said openings (32*a*) are provided outwardly of said openings (32*a*) of said cam groove (32), respectively.

5. The LIF connector according to claim 2, wherein an opening (32*a*) for introducing said guide pin (22) of said second connector (20) into said slanting cam groove (32) of said slider (30) is formed at one end of each of said slanting cam grooves (32), and holders (34) for respectively guiding said guide pins (22) of said second connector (2) into said openings (32*a*) are provided outwardly of said openings (32*a*) of said cam groove (32), respectively.

6. The LIF connector according to claim 4, wherein holder guides (14) for respectively guiding said holders (34) of said slider (30) are formed on said first connector (10).

7. The LIF connector according to claim 5, wherein holder guides (14) for respectively guiding said holders (34) of said slider (30) are formed on said first connector (10).

8. The LIF connector according to claim 1, wherein an anti-slip portion (35) for enabling a finger to slide said slider (30) is formed on an upper surface of said slider (30).

9. The LIF connector according to claim 2, wherein an anti-slip portion (35) for enabling a finger to slide said slider (30) is formed on an upper surface of said slider (30).

10. The LIF connector according to claim 3, wherein an anti-slip portion (35) for enabling a finger to slide said slider (30) is formed on an upper surface of said slider (30).

11. The LIF connector according to claim 4, wherein an anti-slip portion (35) for enabling a finger to slide said slider (30) is formed on an upper surface of said slider (30).

12. The LIF connector according to claim 5, wherein an anti-slip portion (35) for enabling a finger to slide said slider (30) is formed on an upper surface of said slider (30).

13. The LIF connector according to claim 6, wherein an anti-slip portion (35) for enabling a finger to slide said slider (30) is formed on an upper surface of said slider (30).

14. The LIF connector according to claim 7, wherein an anti-slip portion (35) for enabling a finger to slide said slider (30) is formed on an upper surface of said slider (30).

* * * * *